US008683754B2

(12) United States Patent
Peterson

(10) Patent No.: US 8,683,754 B2
(45) Date of Patent: Apr. 1, 2014

(54) INSULATING MEMBER FOR BUILDING CONSTRUCTION

(76) Inventor: Joseph Peterson, Allentown, PA (US)

( * ) Notice: Subject to any disclaimer, the term of this patent is extended or adjusted under 35 U.S.C. 154(b) by 0 days.

(21) Appl. No.: 13/409,854

(22) Filed: Mar. 1, 2012

(65) Prior Publication Data

US 2013/0227900 A1 Sep. 5, 2013

(51) Int. Cl.

| | |
|---|---|
| ***E04D 13/16*** | (2006.01) |
| ***E04B 7/00*** | (2006.01) |
| ***F24F 7/02*** | (2006.01) |
| ***E04D 13/17*** | (2006.01) |
| *E04D 13/152* | (2006.01) |
| *E04D 13/155* | (2006.01) |

(52) U.S. Cl.

CPC ..... *E04D 13/178* (2013.01); *E04D 13/152* (2013.01); *E04D 13/155* (2013.01)

USPC ..... 52/95; 52/96; 454/260

(58) Field of Classification Search

USPC ..... 52/95, 96, 302.1, 198, 199, 404.1, 52/407.1, 407.2, 407.3, 407.5, 57, 94, 52/302.3; 454/260, 239, 250, 251, 365, 454/366, 367

See application file for complete search history.

(56) References Cited

U.S. PATENT DOCUMENTS

| | | | | |
|---|---|---|---|---|
| 1,921,518 | A * | 8/1933 | Frobisher | 52/407.3 |
| 3,748,803 | A | 7/1973 | Widerby et al. | |
| 3,972,164 | A * | 8/1976 | Grange | 52/95 |
| 4,102,092 | A | 7/1978 | Ward | |
| 4,160,346 | A | 7/1979 | Kaufmann | |
| 4,189,878 | A * | 2/1980 | Fitzgerald | 52/95 |
| D256,157 | S * | 7/1980 | Ward | D23/393 |
| 4,214,510 | A | 7/1980 | Ward | |
| 4,223,489 | A | 9/1980 | Bentley | |
| 4,269,007 | A | 5/1981 | Ward | |
| 4,446,661 | A | 5/1984 | Jonsson et al. | |
| 4,516,363 | A | 5/1985 | Beaulieu et al. | |
| 4,601,135 | A | 7/1986 | Ellis et al. | |
| 4,611,443 | A | 9/1986 | Jorgensen et al. | |
| 4,660,463 | A | 4/1987 | Bottomore et al. | |
| 4,663,908 | A | 5/1987 | Kestel, Jr. | |
| 4,998,390 | A | 3/1991 | Glover et al. | |
| 5,361,551 | A * | 11/1994 | Post | 52/95 |
| 5,596,847 | A | 1/1997 | Stephenson | |
| 6,079,166 | A * | 6/2000 | Mason et al. | 52/198 |
| 7,101,608 | B1 | 9/2006 | Karnes | |
| 7,644,545 | B2 * | 1/2010 | Mankell et al. | 52/95 |
| 7,921,619 | B2 | 4/2011 | Snyder et al. | |
| 2008/0163565 | A1 | 7/2008 | Toas | |
| 2011/0030287 | A1 | 2/2011 | Moore | |

* cited by examiner

*Primary Examiner* — Mark Wendell
*Assistant Examiner* — Kyle Walraed-Sullivan
(74) *Attorney, Agent, or Firm* — Sanford J. Piltch

(57) ABSTRACT

An insulating member is disposed between the top of a wall and the underside of a roof to more effectively insulate the structure and prevent condensation fostering growth of mold and mildew occurring along the surfaces of the wall, ceiling and roof. A first surface of the insulating member overlies the top plate of the wall extending inward between the ceiling joists a distance of at least 1.5 feet. A second surface overlies the outside surface of the wall extending downward along the exterior of the wall a distance of at least 0.5 feet. A third surface is shaped to substantially conform to the opposing underside of the roof deck such that the space between the roof deck and the wall top plate is sealed off by the insulating member. Multiple air flow pathways extend through the insulating member providing continuous air flow from soffit area into the attic space.

5 Claims, 2 Drawing Sheets

INSULATING MEMBER FOR BUILDING CONSTRUCTION

BACKGROUND OF THE INVENTION

The present invention generally relates to an insulating member for use in the construction of buildings, and more particularly, to an insulating member to be disposed between the upper top plate of a wall and the underside of the roof decking of the roof of a building.

The effective thermal insulation of buildings, both residential and commercial, has become a crucial concern for builders and homeowners as the cost of heating and cooling has increased and the desire to reduce one's carbon footprint and go "green." For this reason, in addition to the basic thermal insulation properties of ordinary wood and masonry, it has become common practice to employ various types of insulating material, such as fiberglass mats or expanding foams, in both new and existing buildings. Such insulating material may typically be installed in loose bales which are spread over the floor of an attic or be sprayed between the studs of a wall. Alternatively, such insulation material may be applied to a new or existing structure by blowing the insulating material, in loose-fill form, into the attic or within a wall, or by spray foaming the same interstitial open spaces between the structural supports for the building.

Loose-fill insulation has the disadvantage that it is often difficult to control the application (depth, evenness, etc.) of the insulation, and it is not unusual for such insulation to clog ventilation conduits or other structures located within the walls or beneath the roof. Further, when such insulation is either blown (for loose-fill) or rolled (for loose bales) into the wedge-shaped recess which is typically defined at the edges of an attic space, between the attic floor and the underside of the inclined roof, an insufficient amount of insulation is often achieved, developing a significant "cold spot" at the intersection between the top plate of the wall, the edge of the ceiling, and the roof. Spray foam requires the blocking off of areas that require air flow and are not considered to be appropriate for the junction of the three building structure components.

The presence of a "cold spot," or area of relatively little insulation, will generally cause inefficiency in heating or cooling of the building. Typically, a ceiling is insulated (with an appropriate insulating material) to an insulation value of "R30", while a wall is typically insulated to an insulation value of "R19." However, at the intersection of the ceiling and roof, there will be a deficiency of insulation material (at the "cold spot"), decreasing the insulation value of the overall construction. What is more, it has been observed that the "cold spot" formed at the intersection of the wall, ceiling and roof tends to cause condensation of moisture, which can lead to the formation of mold and mildew on the inside of the adjacent wall or the underside of the roof decking material without continuing airflow through the area. Over a long period of time, such mold or mildew may contribute to structural decay.

Attempts over the years have been made to address these general problems. For example, U.S. Pat. No. 3,972,164 (Grange) discloses a substantially wedge-shaped insulating member that fits between adjacent roof trusses and between adjacent ceiling joists within the attic space of a structure directly beneath the roof decking material of the inclined roof. In a first embodiment a series of V-shaped grooves or flutes are provided along the upward facing surface of the insulating member to permit a flow of air through the channels formed by the grooves with the inner facing surface of the roof decking material along the underside of the roof. Two other embodiments are also disclosed by Grange. The first provides an internal cavity between the inlet and outlet of the air flow with grooves at each contact point with the roof decking material. The second modifies the wedge-like shape by removing the inward lower facing portion of the wedge while retaining the grooves along the contact edge against the roof decking material. All of the insulating members described by Grange may also include a small lip adapted to engage the outer surface of the exterior wall for positioning purposes. Grange specifically lacks any substantial amount of insulating material that engages along the top plate of the vertical structural wall and extends any length downward along the exterior of the wall to afford sufficient insulating material in this critical are of the structure.

Another example is U.S. Pat. No. 4,611,443 (Jorgensen, et al.) which also describes a wedge-shaped insulating member that is positioned between adjacent roof trusses and adjacent ceiling joists that overlies, but not extend beyond, the wall top plate. An air vent slot is cut into the top surface of the insulating member that abuts the underside of the roof decking material providing an air channel through which air may flow from the soffit into the attic space. An alternative embodiment provides for an inverted channel panel to be inserted in the roof joist spaces to retain insulation below the panel and provide an air channel above and against the roof decking. Neither of the Jorgensen embodiments creates any additional insulating factor between the roof and ceiling, or over the wall, to maintain the insulation (R) value at this critical interface.

U.S. Pat. No. 4,998,390 (Glover, et al.) is still another example of an attempt to provide a shield for insulating material from preventing any air flow from the soffit area to the attic space of a structure. Glover describes a sleeve-like device that extends from the ceiling joist end, over the wall top plate, and ends at the outer wall surface that is dimensioned to receive and contain a batt of insulating material or blown-in loose insulating material. The sleeve is curved inward into the attic space to provide an air pathway above the insulating material and against the underside of the roof decking material between the roof joists. There is lacking any description of extending any insulation downward along the wall exterior in the soffit space to enhance the insulating factor of the device. Further, the structure does not appear sufficiently rigid and can be deformed along its upper side by insulation batts thereby reducing the air channel and the air flow from the soffit area to the attic space.

More recent attempts have included U.S. Pat. No. 7,101,608 (Karnes) that describes a wedge-shaped insulating batt with two air flow channels cut into its top surface. This device acts in a similar fashion to that of the wedge-shaped device of Grange by allowing air flow along the underside of the roof decking material between adjacent roof joists. There is no discussion at all about any extensions outward over or down the exterior wall to provide for additional insulation around the critical junction.

Lastly, U.S. Pat. No. 7,644,545 (Mankell, et al.) is another example of a wedge-shaped insulating batt extending into the wall, ceiling and roof intersection that provides a single air channel cut into its top surface. However, again there is not even a suggestion of extending the insulation outward and downward along the exterior of the wall, ceiling and roof intersection to provide for an enhanced insulation factor at the junction.

While improving the insulation value developed at the intersection of an exterior wall, uppermost room ceiling and roof of a building, the above devices fail in any way to completely insulate the junction of the three structural elements of the building. As a result, while assisting in maintaining the desired insulation value (R30) for the uppermost room ceiling and the attic space of the building, the wall top plate approximates "R7" in insulation value which is significantly less than the desired insulation value (R19) for the wall if a building. In addition to compromising the insulation value for the wall, the proximity of the "cold" space atop the wall tends to promote the formation of mold and mildew, as previously described.

It is, therefore, an object of the present invention to provide more insulation to the junction of the wall, uppermost room ceiling and roof by positioning an insulating member that both separates the attic space from the roof soffit space, but also extends downward along the exterior of the wall for a predetermined distance adding to the insulation factor of the wall adjacent the wall top plate, while providing multiple air flow pathways to promote air movement to substantially eliminate the formation of mold or mildew and to cool the structure in warmer months.

It is another object of the present invention to provide an insulating member which, in addition to insulating the intersection between the ceiling and roof, also insulates the upper, top plate portions of the adjacent wall of the building.

It is also an object of the present invention to create multiple air flow pathways to increase air flow to the attic space to prevent the growth of mold or mildew on the structural surfaces in the attic space.

It is another object of the present invention to provide an insulating member which prevents the condensation of moisture along the top plate of a wall, adjacent to the ceiling.

It is a further object of the invention to act as a barrier against ceiling roof joist insulation in the attic space from blocking the air flow paths by extending the insulating member a distance into the attic space sufficient for the air flow pathways to exit the insulating member above the depth of the insulation in either batt or loose form.

Still a further object is to provide a unified insulating member that is capable of being positioned between adjacent roof rafters and adjacent ceiling joists to seal off the open space therebetween, as well as the open space to the roof soffit space, and to provide multiple air flow pathways through the insulating member to promote air flow from the soffit space, through the insulating member and into the attic space.

It is another object of the present invention to provide an insulating member having such capabilities which may be easily installed without the need for special tools or skills.

Other objects will appear hereinafter.

SUMMARY OF THE INVENTION

The present invention is an insulating member which is formed as a singular structure, preferably comprised of a non-compressible polymer. The insulating member includes a first surface for contacting the top plate of the wall of the building; a second surface for overlaying the outer surface of the wall; and the third surface shaped to conform with, and to be evenly spaced from the underside of the associated roof, adjacent to the top plate of the wall, to create a uniform air gap between the insulating member and the underside of the roof. The insulating member is preferably dimensioned to provide at least three inches of insulating material for surrounding the top plate of the wall, achieving a significant improvement in insulation R value.

The present invention may be described as a polygonal insulating member for sealing off the opening between a soffit space and an attic space in a building structure. The insulating member is comprised of a base rectangular portion having bottom planar surface for contacting and overlying the attic side of a room ceiling and the top plate of an exterior side wall of said structure and opposite side planar surfaces for contacting and fitting between adjacent room ceiling joists and adjacent roof rafters and an extension rectangular portion having an inner planar surface for contacting and overlying the exterior surface of the exterior wall extending downward a predetermined distance extending past the top plate of said exterior side wall. The contiguous insulating member also includes an upper triangular portion coterminous with and directly atop the base rectangular portion for contacting and underlying the roofing panels and opposite side planar surface for contacting and fitting between adjacent roof rafters. In order to provide for air flow between the soffit space and the attic space a first air flow channel is formed into the top surface of the upper triangular portion with the roof panels completing the fourth side of the air flow channel. A second air flow channel extends through the base rectangular and upper triangular portion in parallel to said first air flow channel. Both of the first and second air flow channels provide air flow from the soffit space to the attic space such that the polygonal insulating member provides an increased insulating factor between the soffit space and the attic space while permitting air flow therebetween to reduce moisture retention and staunch the growth of mold and mildew in the soffit and attic spaces.

The polygonal insulating member may be manufactured from a dense closed-cell rigid foam polymer selected from the group consisting of polystyrene, isocyanurate and polyurethane, and combinations thereof. The polygonal insulating member may be either a contiguously formed polygon or be comprised of two parts, a base rectangular portion with depending rectangular extension within the soffit space and an upper triangular portion. When the insulating member is comprised of two parts, the base rectangular portion and the upper triangular portion are aligned conterminously by a positioning tab depending from the underside of the upper triangular portion that fits within a positioning tab receiving aperture located on the upper surface of the base rectangular portion. The positioning tab receiving aperture is located on the upper surface of the base rectangular and has a greater lengthwise dimension to accommodate a lateral offset in the upper triangular portion due to the spatial relationship of the ceiling joists and the roof rafters of the structure.

For further details regarding the insulating member of the present invention, reference is made to the description which is provided below, taken in conjunction with the following illustrations.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 2:
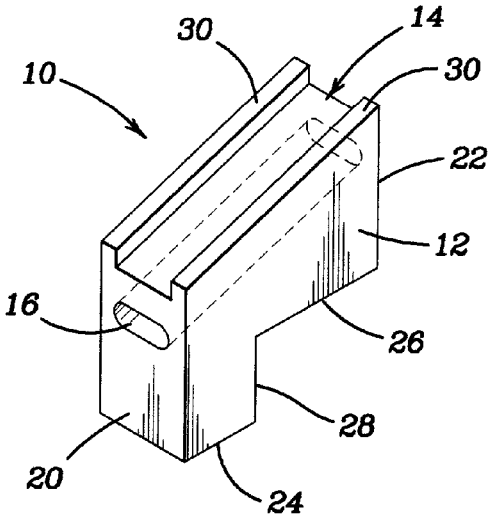
FIG. 2 is an isometric view of one embodiment of the insulating member of the present invention showing the ventilation pathways extending through the member oriented in parallel to the upper surface of the insulating member with one above the other.

Referring now to the drawings in detail, where like numerals refer to like parts or elements, there is shown in FIG. 2 a typical insulating member 10 produced in accordance with the present invention. The insulating member 10 is formed as a solid body 12 which is preferably made of a closed-cell substantially non-compressible foam, of a type conventionally used in insulating materials. The solid body 12 may be covered with a thin plastic film (not shown) to prevent damage in shipping and installation. The insulating member 10 is formed (e.g., molded or extruded) to incorporate a series of surfaces for interacting with the building support structure.

As illustrated in FIG. 2, the insulating member 10 may be formed as a single piece of insulating material defining appropriate surfaces for interacting with the top plate of an exterior structure wall, the joist space of a ceiling, and the adjacent portions of the roof which are to receive the insulating member 10. The insulating member has an exterior surface 20 and an inner or inward facing surface 22 that are upstanding in a substantially vertical orientation when placed in position in a building structure. The bottom surface of the insulating member 10 is broken into to two sections, and outer bottom section 24 and an inner bottom section 26. The two section 24, 26 are separated by a substantially vertical surface 28 which is in parallel to the exterior and inner surfaces 20, 22. An upper facing surface 30 is inclined at an angle to substantially match the slope of the roof line into which an air flow channel 14 is cut as described more fully below.

In order to more appropriately provide for a continuous air flow from the exterior of the structure up through the roof to alleviate the accumulation of condensate from temperature shifts on the building materials, air flow pathways are also formed in the insulating member 10. One air flow channel 14 is formed along the upper surface 30 of the insulating member 10 by cutting away a substantially rectangular cross-section of the upper surface 30 of the insulating member 10 to a depth in the range of 1-2 inches. This cutaway portion or channel 14 extends along the entire upper surface of the insulating member 10 to create an air flow channel 14 against the underside of the roof. An additional air flow channel 16 extends through the insulating member 10 in parallel to the first air flow channel 14 extending a like distance from the outer or exterior surface 20 to inner surface 22 of the insulating member 10. The second air flow channel may be dimensioned to have a depth of between 1 and 2 inches and may be rectangular in cross-section, or have rounded corners so as to appear as an elongated ellipse.

Figure 1:
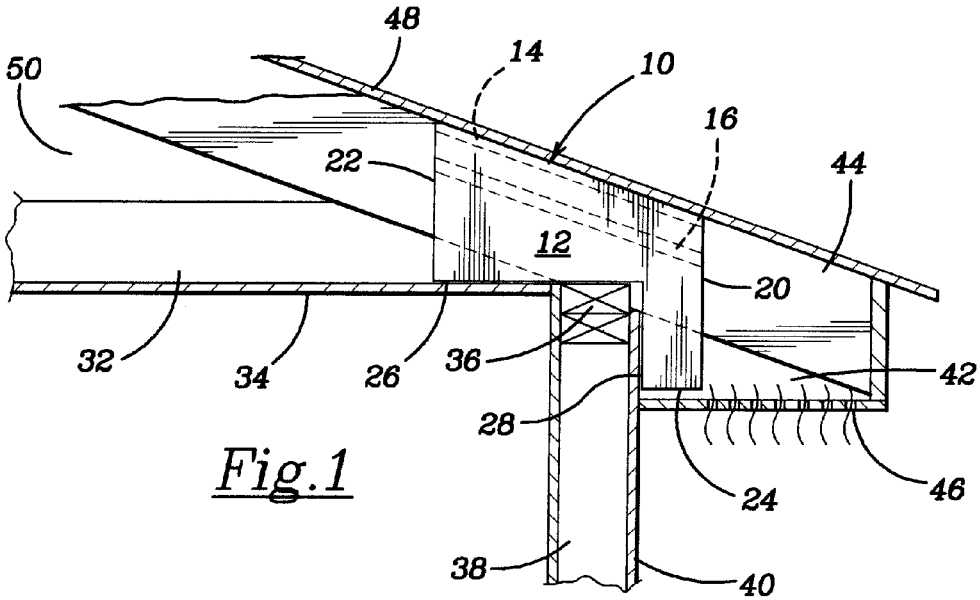
FIG. 1 is a cross-sectional view of the intersection of an exterior wall, a room space ceiling, and roof structure of a building.

Referring now to FIG. 1, the insulating member 10 is positioned between adjacent ceiling joists 32 with the inner bottom section of the bottom surface 26 directly overlying the ceiling wallboard 34. The inner bottom section 26 also overlies the exterior wall top plate 36. The vertical surface 28 is butted up against the exterior of the outer structural wall 38 and positioned against the outer cladding 40 of the wall. The outer cladding can be an OSB board or a multi-thickness plywood that is covered with an air barrier structure wrap such as Tyvek® or similar material. The outer bottom section 24 of the insulating member 10 extends outward from the wall 38 into an enclosed roof soffit space 42. The vertical surface 28 extends downward along the exterior wall 38 a distance sufficient to extend beyond the structural top plate members 36 of the wall 38 and opposite the insulation housed within the wall 38. In this way there is no gap in the insulation in the area of the structural top plate members 36 that are usually wood in a frame construction and do not carry and significant R factor for providing insulation shielding for extreme temperatures.

The soffit space 42 of the structure is formed by the roof trusses or rafters 44 extending outward beyond the building wall 38 a predetermined distance such that an overhang is created to provide for the ingress of outside air up and into the attic space of the structure through the soffit space 42. Along the bottom of the soffit space 42 there may be installed several vents 46 through which air is permitted to flow upward and into the soffit space 42. The air would stagnate and not move from the soffit space 42 except for the air flow channels 14, 16 of the insulating member 10. The air flows through the channels 14, 16 from the soffit space 42 on the outer surface 20 of the insulating member 10, through the insulating member 10, and exiting from the inner surface 22 into the attic space 50. The upper air flow channel 14 creates the defined channel in cooperation with the underside of the roof decking material 48. The insulating member fits within the space between the roof trusses 44 and completely blocks off the opening between the roof trusses 44 into the soffit space 42 at the wall top plate 36. In this way only the air channels 14, 16 are in fluid connection between the soffit space 42 and the attic space 50.

In order to ensure a sufficient insulation [R] value, as well as a secure assembly with the top plate 36 of the wall 38, the dimensions of the inner bottom surface 26 and the outer bottom surface 24 should be kept within certain useful ranges. For example, the inner bottom surface 26 should extend into the attic space 50 from the top plate 36 of the wall 38 at least a distance sufficient for the lower air flow channel 16 to extend above the height of the ceiling joists 32 so that insulation batts or blown-in insulation do not block the free flow of air through the channel 16. The vertical surface 28 should extend downward along the exterior of the wall 38 a minimum of six inches so as to overlie the top end of the insulation housed within the wall 38. The thickness of the exterior portion of the insulating member 10, that portion that is housed within the soffit space 42 is preferred to be between 3-4 inches to provide a sufficient R factor for insulating the upper wall 38 and the top plate 36. This prevents the condensation of moisture where the top plate 36 meets the ceiling 34 both on the interior and exterior of the wall 38. The above dimensions also permit the insulating member 10 to be easily installed between the wall, ceiling and roof of the building, as follows.

Referring again to FIG. 1, the insulating member 10 is installed over the top plate 36 of the wall 38, generally beneath the roof decking material 48 that is coterminous with the height of the roof trusses 44. To this end, the insulating member 10 may be glued in place, once fitted between adjacent room joists 32 and adjacent roof trusses 44 and against the top plate 36 of the wall 38, although once the roof decking material 48 is fastened in place, the insulating member is captured between and among the various structural building members. In any event, installation of the insulating member 10 does not require special skills or tools.

The wall 38 is itself a conventional construction typical in the art, including, for example, a ½ inch thick exterior plywood sheet 40 with a vapor barrier covering, an inner drywall sheet, a double 2×6 top plate. The hollow interior of the wall 38 may be fitted with a quantity of insulation in conventional fashion.

The roof 48 is typically constructed of ⅝ inch plywood decking forming a top surface 48 which may be covered with any of a variety of customary materials, such as asphalt or fiberglass shingles, wooden shakes, etc. all as known in the art. The roof is typically supported by a plurality of evenly spaced rafters or trusses 44. Beneath the roof 48, and over the ceiling 34, is a quantity of insulation, again placed in conventional fashion.

In this context, the insulating member 10 is shown to provide a substantial amount of insulation closing the gap which extends across the openings created between the ceiling 34 and the wall 38, and the roof 48. The downward and outward extension of the insulating member 10 along and outward from the outer surface of the wall 38, serves to provide a suitable amount of insulation where the structure is most exposed, and potentially vulnerable to the decaying effects of moisture and condensation.

The insulating member 10 of the present invention permits certain advantages which were not previously available. For example, the insulating member 10 of the present invention is effective in preventing cold sports, and the formation of mold or mildew from moisture or condensation along the interior surface of the wall 38, by providing a relatively thick (approximately 3-4 inches) quantity of insulating material along the exterior of the wall 38 where there previously existed no insulation. Nevertheless, the dimensions of the insulating member 10, particularly its width and height, are relatively small, preferably only wide enough to enclose the surfaces which it is to contact (overlie), which enables the insulating member 10 of the present invention to be installed easily, and with a minimum intrusion into the structure if a building under construction.

Figure 3:
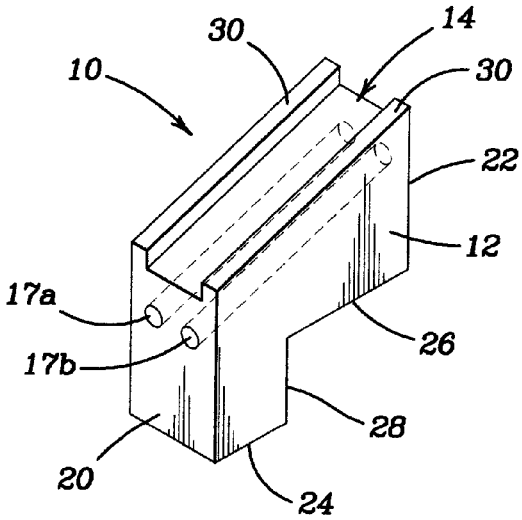
FIG. 3 is an isometric view of a second embodiment of the insulating member of the present invention showing the ventilation pathways extending through the member oriented in parallel to the upper surface of the insulating member, with one above the lower paired air flow pathways.

A second embodiment of the present invention is shown in FIG. 3 in which a different configuration of the air flow channels is shown. The upper air flow channel 14 remains substantially the same, but the lower air flow channel is separated into two sections 17*a*, 17*b*. Other than the separation of the lower air channel into two sections the insulating member 10 remains in the same configuration as described above. The alteration of the lower air channel into two sections 17*a*, 17*b* is intended to be exemplary of any number of air flow channels that can be cut through the insulating member 10 to provide for additional flow of air through the attic space 50. The number and size of the air flow channels is dependent solely upon the dimensions of the insulating member, the depth of the ceiling joists and the incline of the roof rafters.

What has been described above is the configuration of the insulating member 10 that is configured to fit within the roof trusses 44 and ceiling joists 32 that directly overlie one another, ones that are not offset or "sistered" next to each other as they meet over the exterior wall 38. In the event that the roof trusses 44 and the ceiling joists 32 are offset, then the space between adjacent framing structures creates a lower rectangle and an upper rectangle when viewed in cross-section. Likewise, for the insulating member 10 to completely fill the space therebetween, the insulating member 10 must also be altered to fit the changed structural space.

Figure 4:
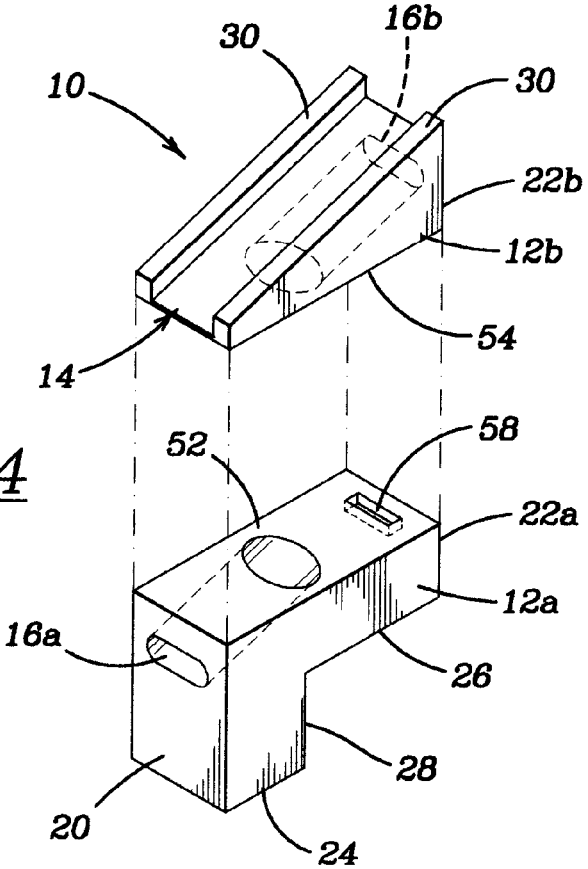
FIG. 4 is an exploded isometric view of a third embodiment of the present invention showing upper and lower insulating member sections for use in retrofitting in existing structures.
Figure 5:
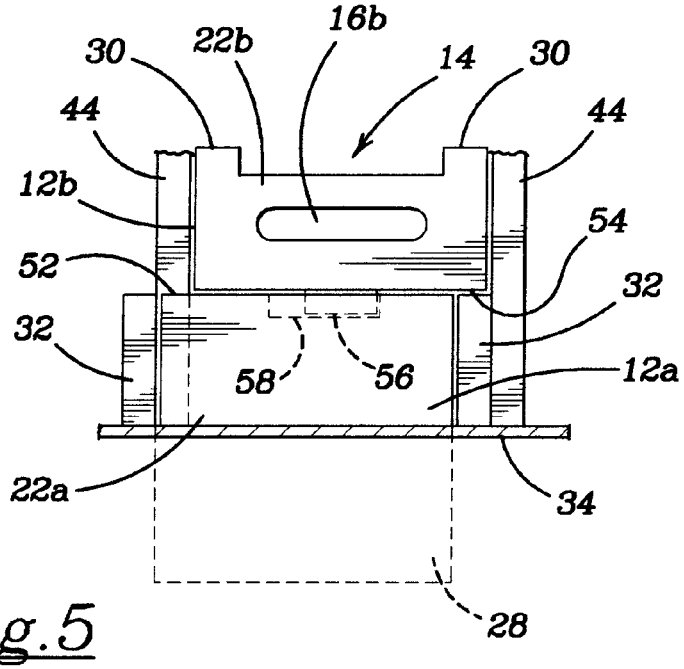
FIG. 5 is a plan view of the third embodiment of the present invention looking outward from the attic space with a rightward offset of the upper insulating member section to the lower insulating member section.

With reference to FIGS. 4 and 5, the insulating member of the present invention is separated into lower and upper sections, 12*a*, 12*b*, respectively. The lower section 12*b* is sized to fit between the ceiling joists 32 and have the same dimensional depth or height as the ceiling joists 32. The joists 32 can be either 6 or 8 inches depending upon the span of the room they are overlying. Therefore the lower section of the insulating member 12*a* will have either a 6 or 8 inch depth or height. The extension of the lower section 12*a* of the insulating member 10 into the soffit space 42 will remain the same in all dimensional aspects. They may be, however, a need to trim some of the lower section 12*a* away at the junction of the faces 20, 24 and new upper face 52 to accommodate the downward slope of the roof rafter 44. In this way the lower section 12*a* of the insulating member 10 will fit flat against the ceiling 34 and fill the lower rectangle of the opening between the attic space 50 and the soffit space 42.

The upper section 12*b* of the insulating member 10 takes the shape of a triangle and retains the upper air flow channel 14 on its upper face 30. As can be seen from FIG. 5, the upper section 12*b* of the insulating member 10 is offset to the right to accommodate the shift in the upper rectangle to accommodate the downward angle of the roof rafter 44 into the opening. Although the two section 12*a*, 12*b* of the insulating member 10 will fill the space, the two sections 12*a*, 12*b* have a cooperating positioning tab 56 and positioning tab receiver 58 to properly align and position the two section 12*a*, 12*b* of the insulating member 10 one atop the other. The positioning tab 56 extends outward and downward from the bottom surface 54 of the upper section 12*a* of the insulating member 10 approximately 3 to 6 inches inward along the bottom surface 54 from the inward facing surface 22*b*. Laterally the positioning tab 56 is centered between the side walls of the upper section 12*b* of the insulating member 10. The positioning tab 56 is preferred to have a length of 3-4 inches, a thickness of ¾-1 inch and a depth of ¾ to 1 inch, all proportionately sized to the overall dimensions of the insulating member 10. The positioning tab receiver 58 is similarly dimension for depth and thickness to accommodate the dimensional size of the positioning tab 56. However, the length of the positioning tab receiver is extended laterally in both directions to accommodate the rightward or leftward offset of a nominal 2 inches due to the intrusion of the roof rafter or truss 44 into the rectangular space. Therefore the length of the positioning tab receiver is preferred to be 7-9 inches in length in order to accommodate the lateral offset of the upper section 12*b* to the lower section 12*a*. The positioning tab receiver 58 is also centered between the sidewalls of the lower section 12*a* and spaced away from the inward face 22*a* a similar distance of the 3-4 inches to be able to receive the positioning tab 56 and properly align the two sections of the insulating member 10 such that the upper air flow channel 14 is directly against the underside of the roof 48 to complete the channel walls.

When the insulating member 10 is split into the upper section 12*b* and the lower section 12*a* the lower air flow channel 16 is directly affected. The air flow channel 16 is also split into two portions. The upper portion of the air flow channel 16*b* is contained in the upper section 12*b* and the lower portion of the air flow channel 16*a* is contained in the lower section 12*a* of the insulating member 10. The positioning tab 56 assists in aligning the two portions of the air channel 16 so that the air flow is relatively uninterrupted due to the offset.

The two sections 12*a*, 12*b* of the insulating member 10 can be securely fastened together by the use of double-face tape across their opposing faces 52, 54 and by taping the seam along the inward face sections 22*a*, 22*b*, if necessary. If properly positioned, the upper and lower sections 12*a*, 12*b* of the insulating member 10 will completely fill the opening between the attic space 50 and the soffit space 42 existing between and among adjacent roof rafters 44 and the underside of the roof decking 48 and the ceiling joists 32 and the upward facing side of the ceiling board 34.

The insulating member 10 may be manufactured from any number of polymer compounds that exhibit sufficient resistance to compression, as well as resistance to moisture and retention of liquids. These polymer compounds can be either thermoplastics, such as expanded polystyrene or extruded polystyrene, or thermosets, such as a polyisocyanurate polyurethane blend. All of these polymers are suited to the type of insulation member contemplated by the present invention. However, denser closed-cell rigid foam forms of the named polymers are better suited to the invention. These polymer foams are either fire resistant or can be treated with a fire resistant chemical. It should be understood that it is preferred that the polymer foam utilized be as dense as possible to significantly reduce water vapor and air flow through the insulating member 10. Also, the increased density produces a more compressed product that resists further compression while in use.

It will therefore be understood that various changes in the details, materials and arrangement of parts which have been herein described and illustrated in order to explain the nature of this invention may be made by those skilled in the art within the principle and scope of the invention as expressed in the following claims.

The invention claimed is:

1. A polygonal insulating member for sealing off the opening between a soffit space and an attic space in a building structure comprising:

an integral body having a base rectangular portion, an extension rectangular portion, and an upper triangular portion with at least first and second air flow channels therethrough;

said base rectangular portion having bottom planar surface for contacting and overlying the attic side of a room ceiling and the top plate of an exterior side wall of said building structure and opposite side planar surfaces for contacting and fitting between adjacent room ceiling joists and adjacent roof rafters;

said extension rectangular portion having an inner planar surface for contacting and overlying the exterior surface of said exterior side wall extending downward a predetermined distance past the top plate of said exterior side wall into the soffit space;

said an upper triangular portion coterminous with and directly atop the base rectangular portion for contacting and underlying the roof decking panels and opposite side planar surface for contacting and fitting between adjacent roof rafters extending under the roof decking panels upward into the attic space;

said first air flow channel formed into the top surface of the upper triangular portion with said roof decking panels completing the fourth side of the air flow channel and said second air flow channel extending through the extension rectangular portion, the base rectangular portion and the upper triangular portions in parallel to said first air flow channel, said first and second air flow channels providing air flow from said soffit space to said attic space, whereby said polygonal insulating member provides an increased insulating factor between said soffit space and said attic space while permitting air flow therebetween to reduce moisture retention and staunch the growth of mold and mildew in the soffit and attic spaces.

2. The polygonal insulating member of claim 1, wherein said insulating member is manufactured from a dense closed-cell rigid foam polymer selected from the group consisting of polystyrene, isocyanurate and polyurethane, and combinations thereof.

3. The polygonal insulating member of claim 1, wherein said insulating member is divided into two contiguous parts, said parts being said base rectangular portion with said extension rectangular portion within the soffit space and said upper triangular portion extending upward into said attic space.

4. The polygonal insulating member of claim 3, wherein the base rectangular portion and the upper triangular portion are aligned conterminously by a positioning tab depending from the underside of the upper triangular portion that fits within a positioning tab receiving aperture located on the upper surface of the base rectangular portion.

5. The polygonal insulating member of claim 4, wherein the positioning tab receiving aperture located on the upper surface of the base rectangular portion is of a greater lengthwise dimension to accommodate a lateral offset in the upper triangular portion due to the spatial relationship of the ceiling joists and the roof rafters of the structure.

* * * * *